United States Patent [19]

Fry

[11] Patent Number: 4,777,773

[45] Date of Patent: Oct. 18, 1988

[54] SIMULATED LOG BUILDING STRUCTURE

[76] Inventor: Alec Fry, Rte. 1, Eagleville, Tenn. 37060

[21] Appl. No.: 172,754

[22] Filed: Mar. 28, 1988

[51] Int. Cl.[4] ..... E04B 1/10

[52] U.S. Cl. ..... 52/220; 52/233

[58] Field of Search ..... 52/220, 221, 233

[56] References Cited

U.S. PATENT DOCUMENTS

| | | | |
|---|---|---|---|
| 2,040,110 | 5/1936 | Tahvonen | 52/233 |
| 2,787,024 | 4/1957 | Johnson | 52/233 |
| 2,829,404 | 4/1958 | Wilson | 52/233 |

FOREIGN PATENT DOCUMENTS

| | | | |
|---|---|---|---|
| 363705 | 12/1981 | United Kingdom | 52/233 |

*Primary Examiner*—Henry E. Raduazo

*Attorney, Agent, or Firm*—Harrington A. Lackey

[57] ABSTRACT

A simulated log building structure in which a plurality of simulated hollow log members are interconnected at their corners by corresponding tubular elbow members in fluid communication with each other so that a fluid medium may be freely circulated throughout all of the walls of a building structure for heating or cooling purposes.

8 Claims, 2 Drawing Sheets

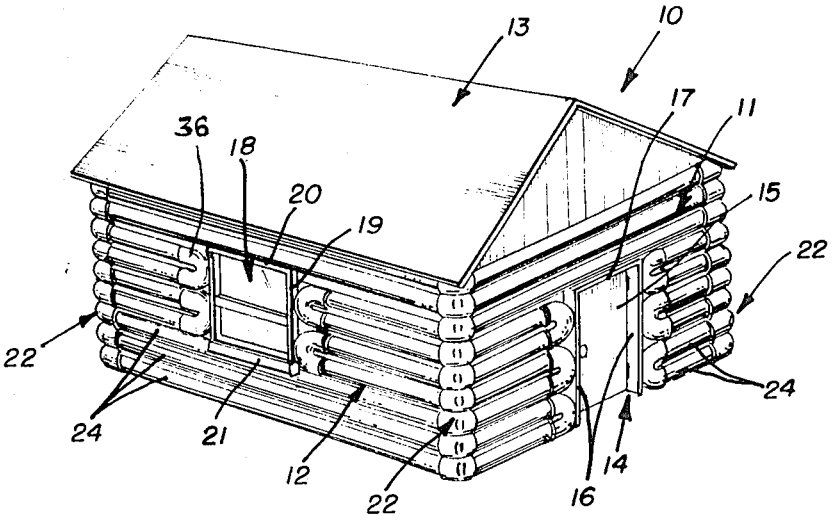
FIG. 1
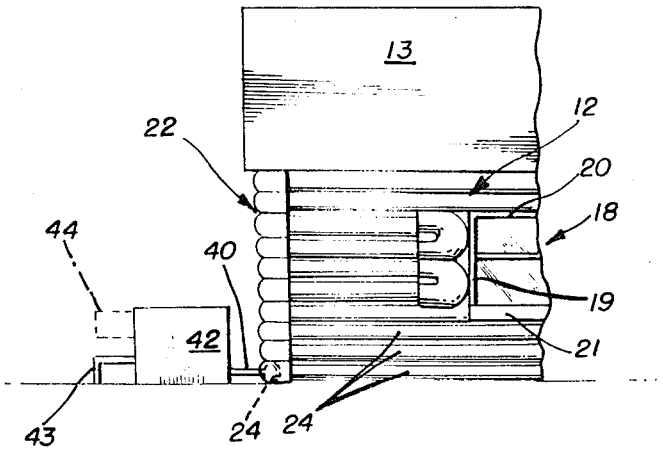
FIG. 2
FIG. 3
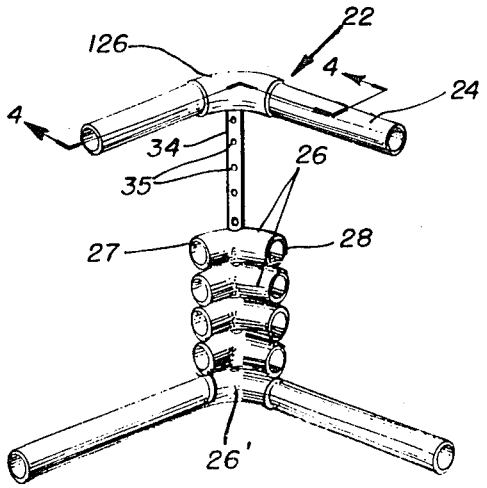

SIMULATED LOG BUILDING STRUCTURE

BACKGROUND OF THE INVENTION

This invention relates to a simulated log building structure, and more particularly to such a building structure in which the log members are hollow.

Heretofore, conventional log construction utilizes solid log members in which the wood material of the logs provides a thermal insulating medium for the building.

The following U.S. patents disclose various building structures in which the logs or simulated logs are hollow:

2,040,110; Tahvonen et al; May 12, 1936
2,635,303; Poynter; Apr. 21, 1953
2,787,029; Johnson; Apr. 2, 1957
3,969,859; Hisey; July 20, 1976
4,309,851; Flagg; Jan. 12, 1982
4,619,089; Stein; Oct. 28, 1986

The patents to Tahvonen et al, Johnson, and Hisey disclose hollow logs for carrying electrical service, such as conduits or cable, and/or gas or plumbing lines.

The patents to Tahvonen et al and Johnson also disclose a vertical passage in the corner of the structure for carrying electrical service conduits and gas and plumbing lines.

Tahvonen et al discloses hollow logs which are in communication with each other through the vertical corner air passages disclosed in FIG. 6, for carrying electrical service conduits, gas or plumbing lines, and also to provide a continuous air passage for insulation purposes.

FIG. 12 of Tahvonen et al discloses a horizontal perforted water pipe extending along the ridge pole of the roof for use in discharging water over the roof in the event of a fire.

None of the above patents disclose a hollow log building structure particularly adapted for carrying air or water throughout all of the walls for heating or cooling purposes.

SUMMARY OF THE INVENTION

The simulated hollow log building construction made in accordance with this invention includes walls formed from a plurality of elongated hollow tubular log members preferably made of plastic material, such as polyvinylcholoride. A plurality of tubular elbow members stacked at the corner portions of the building interconnect the log members of adjacent walls. Upright perforated pipes extend through corresponiing vertically aligned holes or openings in the elbow members to provide continuous fluid communication between all of the elbow members and their corresponding log members.

Where the log members terminate against the frames of openings in the walls, such as windows and doors, the adjacent ends of corresponding pairs of log members are connected by vertically disposed, U-shaped tubular connector members.

Appropriate heating or cooling devices circulate a fluid heat transfer medium, such as air or water, through all of the walls of the building.

BRIEF DESCRIPTION OF THE DRAWINGS

FIG. 1 is a top front perspective view of a simulated log building structure made in accordance with this invention;

FIG. 2 is a fragmentary rear side portion of the structure disclosed in FIG. 1, illustrating a means for supplying the fluid medium to the hollow log members;

FIG. 3 is a fragmentary inside perspective view of a corner portion of the log structure, illustrating some of the stacked elbow members and some of the interconnecting log members;

DESCRIPTION OF THE PREFERRED EMBODIMENTS

Figure 4:
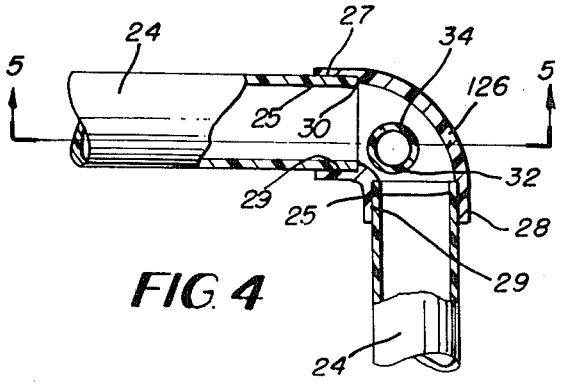
FIG. 4 is an enlarged fragmentary section taken along the line 4—4 of FIG. 3, with portions broken away.

Referring now to the drawings in more detail, FIG. 1 discloses a building structure 10 in the form of a log cabin having a front wall 11, a side wall 12, and a roof 13. Formed in the front wall 14 is a rectangular front door frame 14 supporting a front door 15. The front door frame 14 includes a pair of upright side members 16 and a top frame member 17.

A window opening in the side wall 12 in defined by a rectangular window frame 18 having upright side frame members 19, horizontal top frame member 20, and a window sill 21. Although not disclosed in the drawings, the structure 10 includes an opposite side wall identical to the side wall 12, with or without a window frame 18. In like manner, the back wall, not shown, is identical to the front wall 11 and may or may not include a back door and back door frame corresponding to the front door 15 and the front door frame 14.

The ends of each of the front wall 11, the side wall 12, and the opposite side wall and back wall, not shown, terminate in upright corner portions 22.

Each of the building walls 11 and 12, as well as the opposite side wall and back wall, not shown, are constructed with a plurality of elongated hollow log members 24 which are vertically stacked and extend horizontally or transversely and terminate in opposite end portions 25.

Arranged in each of the corner portions 22 is a vertical stack of elbow members 26. Each elbow member 26 is an L-shaped, hollow tubular casing having opposite open ends 27 and 28, preferably circular in cross-section. The central axes of the open ends of each elbow member 26 intersect at an angle, preferably a right angle, so that the vertically stacked elbow members 26 form an upright right-angle corner portion 22. When the elbow members 26 are vertically stacked, the central axes of the open ends 27 and 28 are substantially horizontal.

Each of the open ends 27 and 28 is provided with an annular or circular internal recess 29 (FIGS. 4 and 5) terminating at its inner end in an annular or circular abutment ledge 30. The diameter of the recess 29 is substantially equal to the exterior diameter of the end portion 25 of each log member 24 so that the end portion 25 can be force-fitted and snugly received within the corresponding annular recess 39 and abut against the annular ledge 30.

Formed in the top and bottom walls of each of the elbow members 26 are a pair of vertically aligned holes 31 and 32, respectively, of equal diameter. However, in the bottom elbow member 26', only a top hole 31 is formed in the top wall, while the bottom wall of the bottom elbow member 26' is solid. Likewise, in the top elbow member 126 (FIG. 3), only a bottom hole 32 is formed in the bottom wall, while the top wall of the top elbow member 126 is solid. When the elbow members 26, 26' and 126 are vertically stacked in a corner portion 22, such as illustrated in the drawings, all of the top and bottom holes 31 and 32 are in vertical alignment for receiving an upright perforated pipe or riser 34 having a plurality of vertically spaced horizontal ports 35 therethrough. Preferably, there is at least one port 35 communicating with the interior of each elbow member 26, 26' and 126 when the perforated pipe 34 is fully assembled within all of the elbow members, as illustrated in the drawings.

The circumferential location of each port 35 is not of particular importance so long as the port 35 is in free fluid communication with the interior of its corresponding elbow member 26 and the log members 24 are connected to a corresponding elbow member 26.

Figure 6:
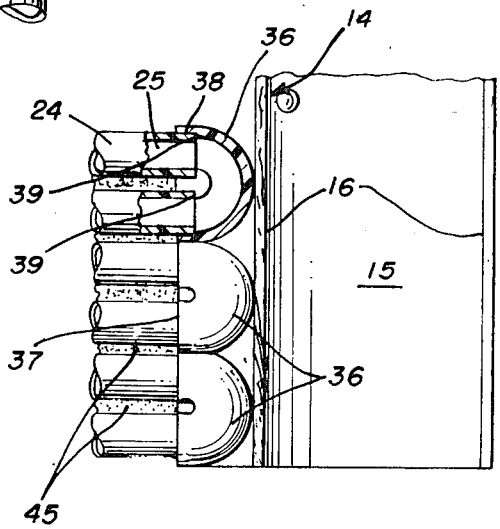
FIG. 6 is an enlarged fragmentary front elevational view of the front door of the building with adjacent log members and U-shaped connector members.
Figure 8:
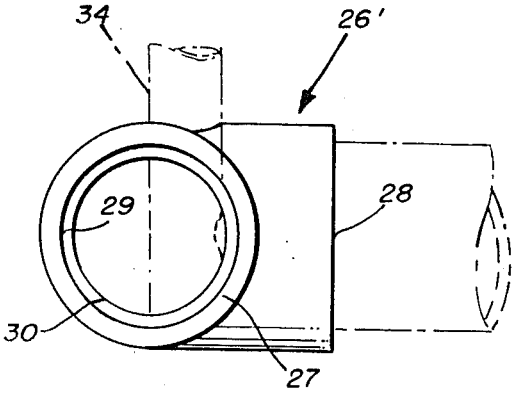
FIG. 8 is an end elevational view taken along the line 8—8 of FIG. 7, with an interconnecting log member and vertical riser shown fragmentarily in phantom.
Figure 7:
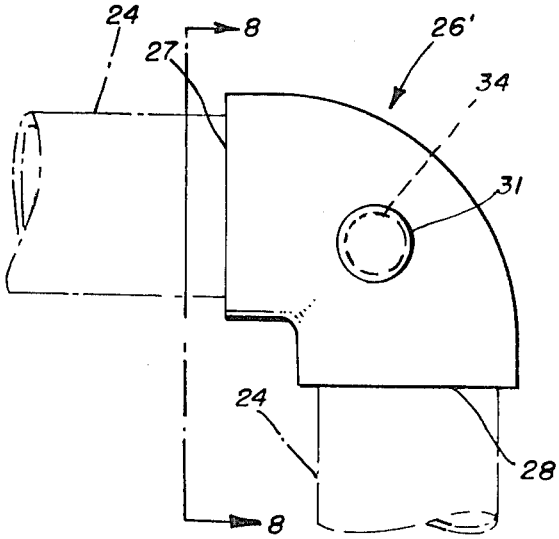
FIG. 7 is an enlarged plan view of one of the elbow members, with interconnecting log members and the vertical riser disclosed in phantom.

As illustrated in FIGS. 1 and 6, the end portions 25 of the hollow log members 24 adjacent the upright side frame members 16 of the front door frame 14 are connected in pairs by a U-shaped connector member 36 having opposite circular open ends 37 (FIG. 6). The opposite end portions of each of the U-shaped connector members 36 is provided with circular internal recesses 38 similar in construction to the recesses 29 of the elbow members 26. The diameters of the open-ended recesses 38 are substantially the same as the outer diameter of each of the log members 24, or at least the end portions 25 of the log members. Thus, a corresponding pair of log members 24 may have their ends force-fitted into the corresponding open recesses 38 and have their ends abut against the corresponding annular ledge 39 of the inner end of each of the recesses 38.

Each of the U-shaped connector members is arranged with one open end 37 above the other, and all of the U-shaped connector members 36 are vertically stacked, as clearly shown in FIGS. 1 and 6. Thus, each adjacent pair of hollow log members 24 are in fluid communication with each other adjacent the door opening. The U-shaped connector members 36 are also used adjacent the upright window side frame members 19, as clearly illustrated in FIGS. 1 and 2.

Accordingly, by utilizing only four tubular elements, namely the hollow log members 24, the elbow members 26, the perforated vertical pipes or risers 34, and the U-shaped connector members 36, the entire house 10 may be assembled in which all of the walls include hollow spaces which are in fluid communication throughout all of the walls, even where the walls have window and door openings.

Figure 5:
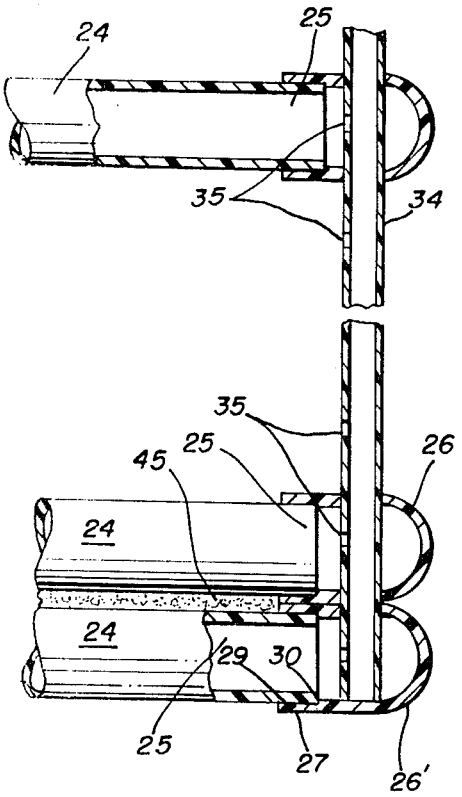
FIG. 5 is a fragmentary section taken along the line 5—5 of FIG. 4, illustrating a corner portion of the structure, with several of the log members removed, and with portions broken away.

Because of the spacing between the log members 24 created by their slip-fit connections within their corresponding connector members 26 and 36, caulking 45 is introduced into the spaces between the log members 24 to completely seal the interior of the building structure 10, as disclosed in FIGS. 5 and 6.

Appropriate fluid, either air or water, or any other gas or liquid, may be supplied to any one of the log members 24 or elbow members 36 at any desired location. As illustrated in FIG. 2, a bottom back log member 24 (in phantom) is connected to an inlet pipe 40 from a heat pump, furnace, water pump, or air conditioner 42 mounted on the ground outside the rear of the building structure 10. The heat pump 42 may be supplied from an external water source through a water supply pipe 43, or it may be supplied with ambient air through the inlet fan 44, shown in phantom. FIG. 2 discloses the inlet water or air pipe 40 connected to the bottom log 24, which is advantageous in the event that the fluid is hot to permit the hot fluid to naturally rise, in addition to being forced upward through the walls of the building by the heat pump 42. The heat in the walls of the building structure 10 is then transmitted to the interior space of the structure 10.

On the other hand, if it is desired to cool the building, the heat pump or air conditioner could be connected to a top log to introduce the cold fluids so that the fluid would naturally gravitate downward and circulate through the log members 24 and their connector members throughout all the walls of the structure.

The building structure 10 could of course take many various forms, such as a residence, a commercial structure, an out building on a farm or a building to house animals or agricultural products.

What is claimed is:

1. A building structure comprising:

(a) a pair of walls having an intersecting corner portion, (b) said corner portion comprising a plurality of hollow elbow members having opposite open ends, said elbow members being stacked in an upright direction, said open ends opening transversely from said upright direction, (c) each wall having a plurality of upright stacked, transversely extending, elongated, hollow log members having open end portions adjacent said corner portion, said open end portion of a log member in each said pair of walls being in fluid communication with a corresponding opposite open end of the same elbow member, (d) said elbow members stacked in said corner portion having aligned communicating holes in said upright direction, and (e) an elongated, perforated pipe extending upright through said aligned holes, said pipe having at least one open port within each of said elbow members so that all of said elbow members and said hollow log members are in fluid communication.

2. The invention according to claim 1 in which each of said elbow members comprises a tubular casing terminating in said opposite open ends, the central axes of said open ends intersecting each other at an angle and lying in a common medial plane, said aligned holes extending through each of said casings along an axis normal to said medial plane.

3. The invention according to claim 2 in which the bottom elbow member in said stack in said corner portion includes only a single hole in the top of said casing, the uppermost said elbow member including a single hole in the bottom of said casing, and all intermediate elbow members between said top and bottom elbow members include upper and lower aligned holes.

4. The invention according to claim 2 in which each of said open ends in each of said elbow members comprises an enlarged internal cylindrical recess of substantially the same diameter as the exterior diameter of the corresponding open end portion of the log member in fluid communication with said open end of said elbow member, said open end portion being received within said recess in an assembled position.

5. The invention according to claim 4 in which each of said cylindrical recesses has an inner abutment ledge against which the end of said corresponding log member abuts in the assembled position.

6. The invention according to claim 1 in which at least one of said walls includes a frame defining an opening through said wall, said frame having opposed upright frame members, a plurality of U-shaped tubular connector members having a pair of open end portions and a closed end portion, said closed end portions being adapted to abut against said opposed upright frame members, said open end portions of said U-shaped tubular connector members receiving corresponding open end portions of log members in fluid communication.

7. The invention according to claim 1 further comprising a plurality of walls and corner portions defining an enclosure and all of said hollow log members and elbow members are in fluid communication.

8. The invention according to claim 7 further comprising means for circulating fluid through said hollow log members and said elbow members.

* * * * *